US009206811B2

(12) United States Patent
Clark et al.

(10) Patent No.: US 9,206,811 B2
(45) Date of Patent: Dec. 8, 2015

(54) REMANUFACTURED PUMP AND PUMP REMANUFACTURING METHOD

(75) Inventors: Donald Gene Clark, Iuka, MS (US); Curtis John Graham, Peoria, IL (US); Jack Maclellan Nix, Booneville, MS (US); Caxton Darnell Martin, Jr., Corinth, MS (US)

(73) Assignee: Caterpillar Inc., Peoria, IL (US)

( * ) Notice: Subject to any disclaimer, the term of this patent is extended or adjusted under 35 U.S.C. 154(b) by 765 days.

(21) Appl. No.: 13/539,572

(22) Filed: Jul. 2, 2012

(65) Prior Publication Data

US 2014/0003921 A1 Jan. 2, 2014

(51) Int. Cl.

*F04D 29/06* (2006.01)
*F04D 29/10* (2006.01)
*F04D 29/12* (2006.01)

(52) U.S. Cl.

CPC ..... *F04D 29/061* (2013.01); *F04D 29/106* (2013.01); *F04D 29/126* (2013.01); *Y10T 29/49238* (2015.01)

(58) Field of Classification Search

CPC ..... F04D 29/61; F04D 29/061; F04D 29/10; F04D 29/106; F04D 29/108; F04D 29/12; F04D 29/126

See application file for complete search history.

(56) References Cited

U.S. PATENT DOCUMENTS

| | | | | |
|---|---|---|---|---|
| 3,474,733 | A | 10/1969 | Saletzki et al. | |
| 5,409,350 | A | 4/1995 | Mitchell | |
| 5,562,406 | A * | 10/1996 | Ooka et al. | 415/112 |
| 5,827,041 | A | 10/1998 | Charhut | |
| 7,934,303 | B2 | 5/2011 | Awwad et al. | |

FOREIGN PATENT DOCUMENTS

| | | | |
|---|---|---|---|
| EP | 0899462 | | 3/1999 |
| EP | 1471261 | | 10/2004 |
| FR | 959111 | A * | 3/1950 |
| JP | 2002310095 | A * | 10/2002 |

OTHER PUBLICATIONS

Machine Translation FR 959111 A. Accessed EPO website Apr. 22, 2015. 6 Pages.*

* cited by examiner

*Primary Examiner* — Richard Edgar

(57) ABSTRACT

A remanufactured pump includes a casing and a pumping mechanism positioned within the casing having a rotatable pump shaft and an impeller mounted upon the pump shaft and rotatable within a pumping chamber in the casing. A first insert is held fast within a first bore in the casing, and a second insert is held fast within a second bore in the casing, each via an interference fit. Sealing mechanisms are positioned within the first and second inserts to form a first seal about the pump shaft to prevent leakage of a working fluid from the pumping chamber, and a second seal about the pump shaft to prevent leakage of a lubricating fluid from a bearing chamber in the casing. Related methodology is also disclosed.

17 Claims, 6 Drawing Sheets

REMANUFACTURED PUMP AND PUMP REMANUFACTURING METHOD

TECHNICAL FIELD

The present disclosure relates generally to the field of remanufacturing, and relates more particularly to remanufacturing a pump casing via interference fitting inserts for positioning sealing mechanisms into newly formed bores in the pump casing.

BACKGROUND

The fields of machine component salvaging and remanufacturing have grown rapidly in recent years. Systems and components that only recently would have been scrapped are now repaired and/or refurbished and returned to service. For many years machine components have routinely been "rebuilt" and used again, but often only after the components' dimensions, operating characteristics or other features are modified out of necessity from original specs. It is more desirable in many instances for systems and components to be remanufactured to a condition as good or better than new. With this goal in mind, the development of remanufacturing strategies in certain technical areas has been rapid. In other areas, however, and in the case of certain specific parts, engineers continue to find it challenging to return components to a commercially and technically acceptable state, much less a condition identical to or better than that held in a former service life.

Chief among the challenges in successfully remanufacturing certain machine components is the difficulty in holding tolerances in a repair process. Geometric tolerancing and dimensional tolerancing are often relatively tightly specified for new parts. Where the new part consists of a casting or the like, it is often possible to machine features of interest on the new casting while held in a chuck or fixture in a single machining cell, and hence tight tolerances are more readily achievable. Machining for repair purposes and the like, however, often requires that the part be processed on multiple different machines, or with multiple different machining tools which cannot so readily be located and controlled as is the case with newly manufactured parts. For these and other reasons, successful remanufacturing strategies for many parts remain elusive. One known remanufacturing strategy for hydraulic pumps is set forth in commonly owned U.S. Pat. No. 7,934,303 to Awwad et al.

SUMMARY

In one aspect, a remanufactured pump for a machine cooling system includes a casing removed from service in a machine cooling system and defining a working fluid inlet, a working fluid outlet, a pumping chamber fluidly between the working fluid inlet and outlet, and a bearing chamber, and the casing further defining a first bore adjoining the pumping chamber, and a second bore adjoining the bearing chamber. The pump further includes a pumping mechanism having a rotatable pump shaft extending through the first and second bores, and an impeller mounted upon the pump shaft and rotatable within the pumping chamber. The pump further includes a first insert held fast within the first bore via an interference fit, and having a first cylindrical inner surface, and a second insert held fast within the second bore via an interference fit, and having a second cylindrical inner surface. The pump further includes a first sealing mechanism positioned at least partially within the first insert in contact with the first cylindrical inner surface and forming a first seal about the pump shaft to prevent leakage of a working fluid from the pumping chamber, and a second sealing mechanism positioned at least partially within the second insert in contact with the second cylindrical inner surface and forming a second seal about the pump shaft to prevent leakage of a lubricating fluid from the bearing chamber.

In another aspect, a remanufactured pump casing removed from service in a machine cooling system includes a body defining a working fluid inlet, a working fluid outlet, and a pumping chamber positioned fluidly between the working fluid inlet and outlet and configured to receive an impeller for transitioning a working fluid from the working fluid inlet to the working fluid outlet. The body further defines a bearing chamber, a first bore adjoining the pumping chamber, and a second bore adjoining the bearing chamber, and the first and second bores being configured to receive a rotatable pump shaft therethrough having the impeller mounted thereon. The pump casing further includes a first insert held fast within the first bore via an interference fit, the first insert having a first cylindrical inner surface and being configured to receive a first sealing mechanism for forming a first seal about the pump shaft to prevent leakage of the working fluid from the pumping chamber. The pump casing further includes a second insert held fast within the second bore via an interference fit, and having a second cylindrical inner surface and being configured to receive a second sealing mechanism for forming a second seal about the pump shaft to prevent leakage of a lubricating fluid from the bearing chamber.

In still another aspect, a method of remanufacturing a pump includes receiving a casing for the pump removed from service in a machine cooling system, the casing having a first seal bore adjoining a pumping chamber configured to receive an impeller for transitioning a working fluid from a working fluid inlet to a working fluid outlet, and a second seal bore adjoining a bearing chamber configured to receive a bearing for a rotatable pump shaft coupled with the impeller. The method further includes supporting the casing upon a fixture defining a first set of positioning coordinates for repairing a first seal bore defect in the casing, and repairing the first seal bore defect while supported upon the fixture via machining the casing to remove material forming the first seal bore, interference fitting a first insert into the casing in place of the removed material, and finish machining an inner surface of the first insert to a cylindrical shape. The method further includes establishing a second set of positioning coordinates for repairing a second seal bore defect in the casing via decoupling the casing from the fixture and probing the casing. The method still further includes repairing the second seal bore defect while decoupled from the fixture via machining the casing to remove material forming the second seal bore, interference fitting a second insert into the casing in place of the removed material, and finish machining an inner surface of the second insert to a cylindrical shape.

DETAILED DESCRIPTION

Figure 1:
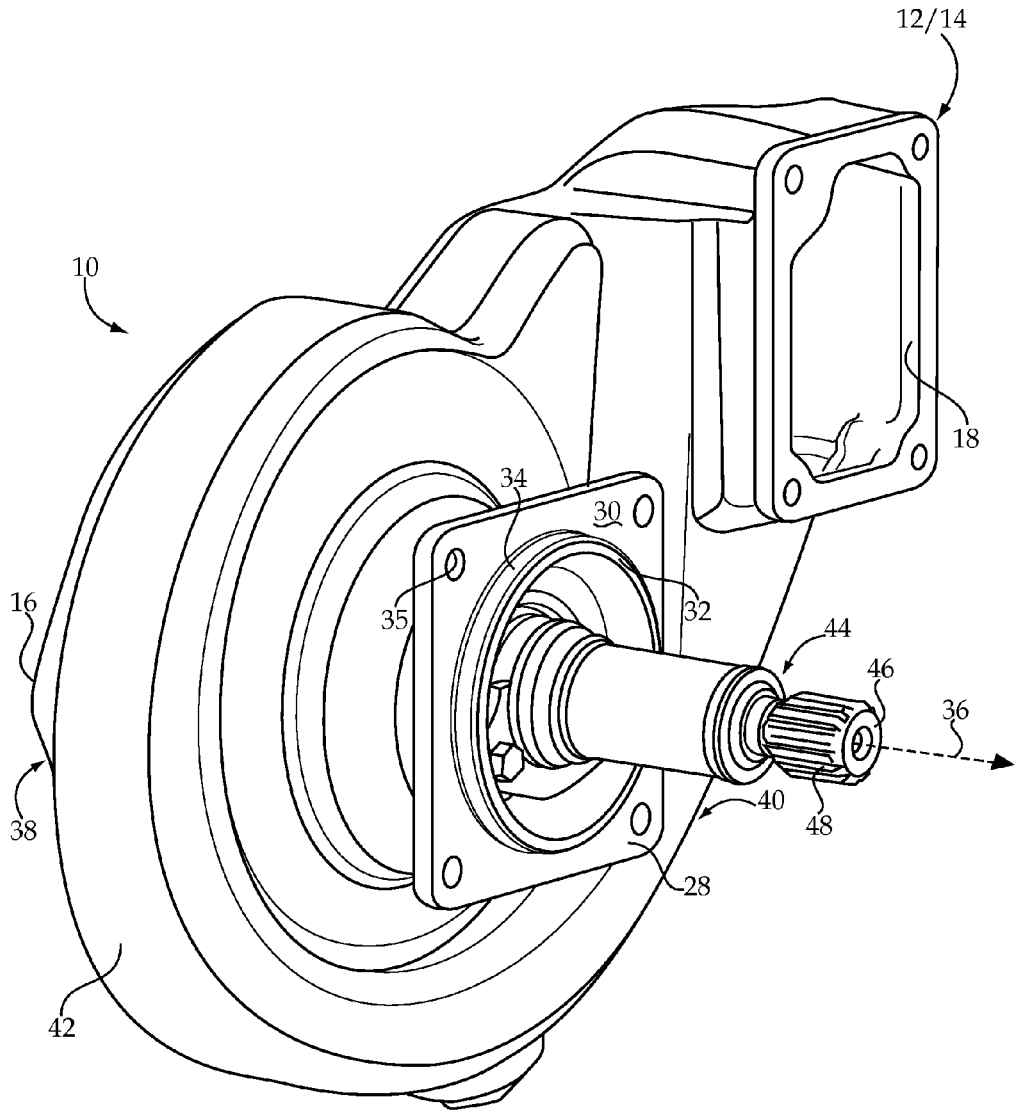
FIG. 1 is a diagrammatic view of a remanufactured pump according to one embodiment.

Referring to FIG. 1, there is shown a remanufactured pump 10 having a casing 12 removed from service in a machine cooling system such as an engine cooling system. Casing 12 has a body 14 defining a working fluid inlet 16 configured to receive a working fluid such as water, engine coolant or a mixture, and a working fluid outlet 18. In a practical implementation strategy, pump 10 may be operated to transition a working fluid between inlet 16 and outlet 18 for circulation through a machine component to be cooled, such as an engine block, and a heat exchanger in a conventional manner. Pump 10 may be mounted directly to an engine housing to receive the working fluid into inlet 16 via a suitable conduit, and a second conduit can be coupled with outlet 18 to enable discharge of pumped working fluid back to the heat exchanger and engine block for returning to inlet 16. Casing 12 may include a mounting flange 28 having a plurality of bolt holes 35 formed therein for mounting casing 12 to the engine housing, and a mounting protuberance 32 projecting from flange 32. A planar locating surface 30 may be located on flange 28, and a cylindrical locating surface 34 may be located on protuberance 32 and defines a center axis. Locating surface 30 may be oriented normal to locating surface 34, and also normal to center axis 34. A volute 42 is positioned near first axial end 38 and forms a fluid conduit connecting inlet 16 with outlet 18. Pump 10 also includes a pumping mechanism 44 having a rotatable pump shaft 46 which is centered about axis 36, and rotatable via engagement between a plurality of flutes 48 and a gear rotatable via the engine.

Figure 3:
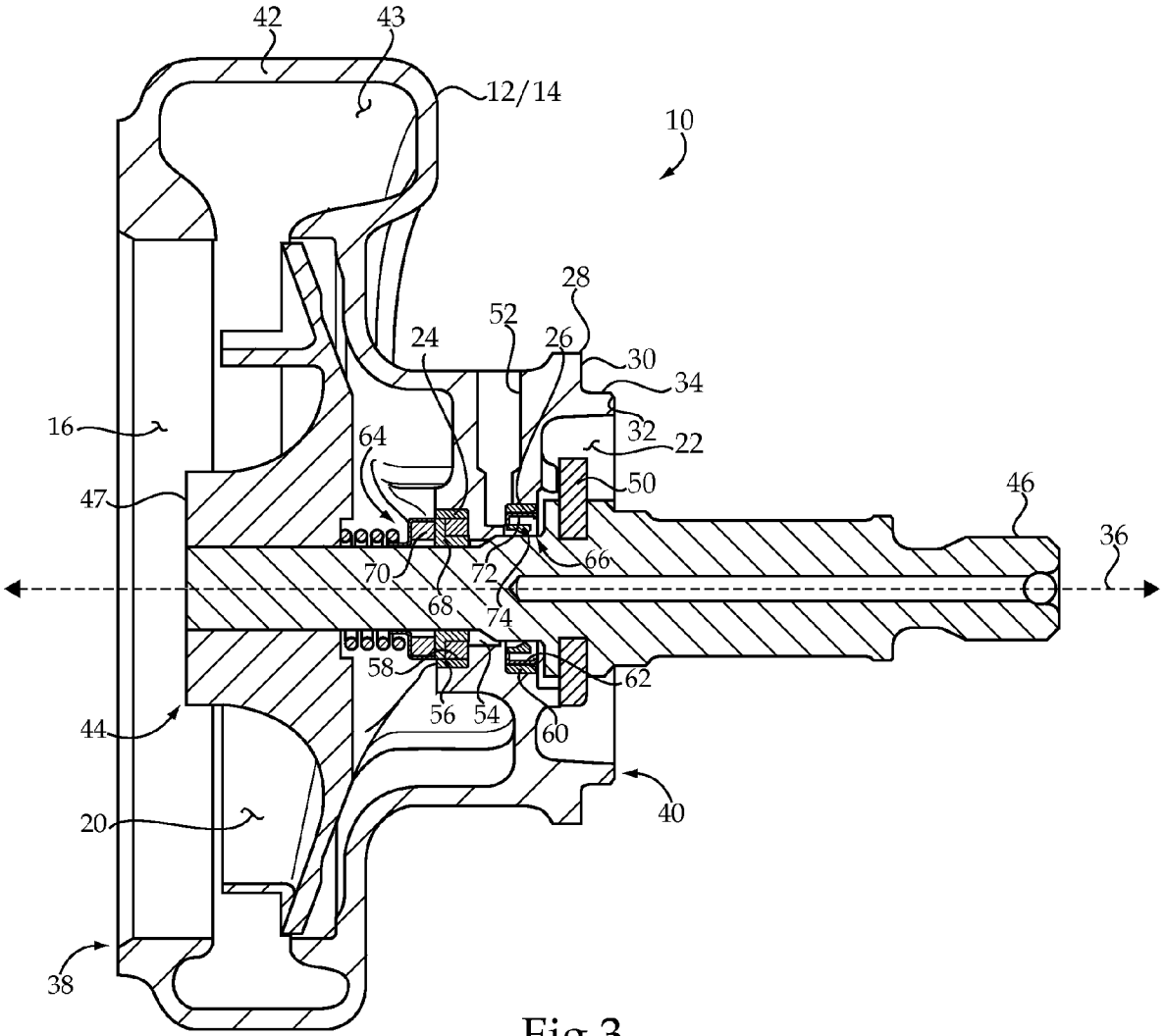
FIG. 3 is a sectioned side view of the pump of FIG. 1.

Referring also now to FIG. 3, there is shown a sectioned side view of pump 10, showing among other things an impeller 47 of pumping mechanism 44 mounted upon pump shaft 46. Impeller 47 is rotatable within a pumping chamber 20 positioned fluidly between inlet 16 and outlet 18 and fluidly connecting with outlet 18 via the conduit 43 formed by volute 42. Casing 12 further defines a bearing chamber 22, a first bore 24 adjoining pumping chamber 20 and a second bore 26 adjoining bearing chamber 22. A first insert 56 is held fast within first bore 24 via an interference fit, and a second insert 60 is held fast within second bore 26 also via an interference fit. A suitable adhesive such as Loctite® 620 may also be used to assist in retaining inserts 56 and 60 within bores 24 and 26 respectively. First insert 56 includes a first cylindrical inner surface 58, whereas second insert 60 includes a second cylindrical inner surface 62. As will be further apparent from the following description, inserts 56 and 60 may be positioned within pump casing 12 in place of material of casing 12 removed during remanufacturing to repair corrosion, pitting, warping, or other defects. In a practical implementation strategy, casing 12 is formed of cast iron, and each of inserts 24 and 26 includes a stainless steel ring. Inserts 24 and 26 may be formed for example from IE0919 stainless steel, having thermal expansion properties relatively similar to those of cast iron.

Pump 10 further includes a first sealing mechanism 64 positioned at least partially within first insert 56 and in contact with inner surface 58. Sealing mechanism 64 forms a first seal about pump shaft 46 to prevent leakage of working fluid from pumping chamber 20. Pump 10 also includes a second sealing mechanism 66 positioned at least partially within second insert 60 and in contact with inner surface 62. Sealing mechanism 66 forms a second seal about pump shaft 46 to prevent leakage of a lubricating fluid from bearing chamber 22. In the illustrated embodiment, pumping mechanism 44 includes a thrust bearing 50 coupled with pump shaft 46. Thrust bearing 50 will typically be bathed in lubricating oil and sealed against leakage via sealing mechanism 66. Bearing chamber 22 may be closed via the coupling of casing 12 with a machine system housing, appropriately ported to supply lubricating oil into chamber 22 in a suitable manner. In a practical implementation strategy, first sealing mechanism 64 may include a face seal, and second sealing mechanism 66 may include a lip seal. Those skilled in the art will be familiar with different sealing strategies and seal design requirements for sealing water, coolant, mixtures thereof, versus sealing lubricating oils and the like. To this end, first sealing mechanism 64 may include a stationary seat 68 in contact with first cylindrical inner surface 58, and a rotatable sealing ring 70 positioned upon pump shaft 46 and rotatable therewith to form the face seal with seat 68. Second sealing mechanism 66 may include a stationary seal carrier 72 contacting second cylindrical inner surface 62, and a stationary sealing ring 74 forming the lip seal with pump shaft 46. Each of seat 68 and seal carrier 72 may be interference fitted within the corresponding insert. In the embodiment shown, inner surface 58 defines a smaller inner diameter dimension, in a direction normal to axis 36, whereas inner surface 62 defines a larger inner diameter dimension. During operating pump 10 there will typically be a minor amount of leakage past each of sealing mechanisms 64 and 66. To accommodate such leakage, casing 12 further defines a low pressure space 52, for instance open to ambient, and a weep chamber 54 to collect the leaked fluids, and extending between first and second bores 24 and 26 and in fluid communication with low pressure space 52.

Figure 2:
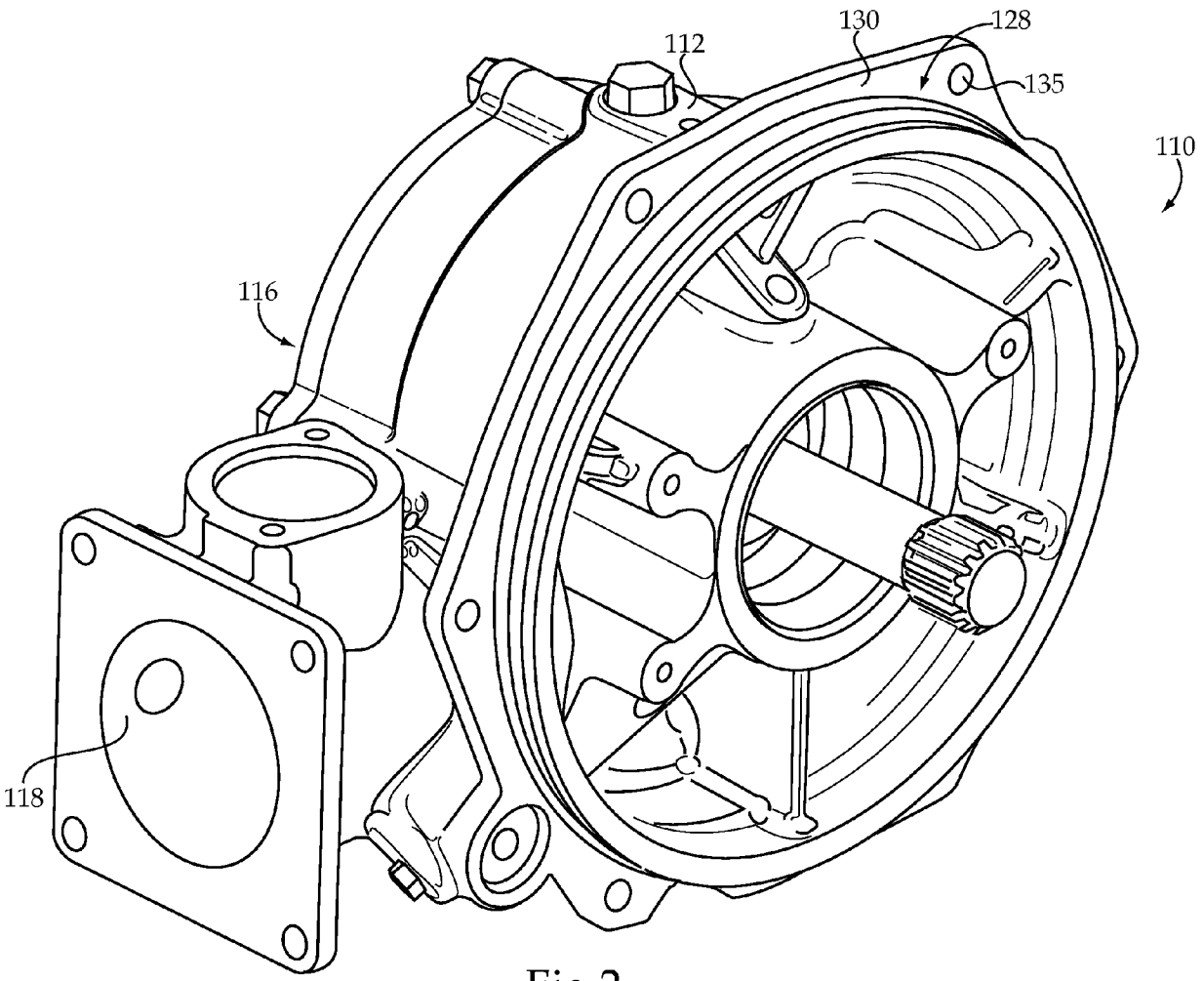
FIG. 2 is a diagrammatic view of a remanufactured pump according to another embodiment.
Figure 4:
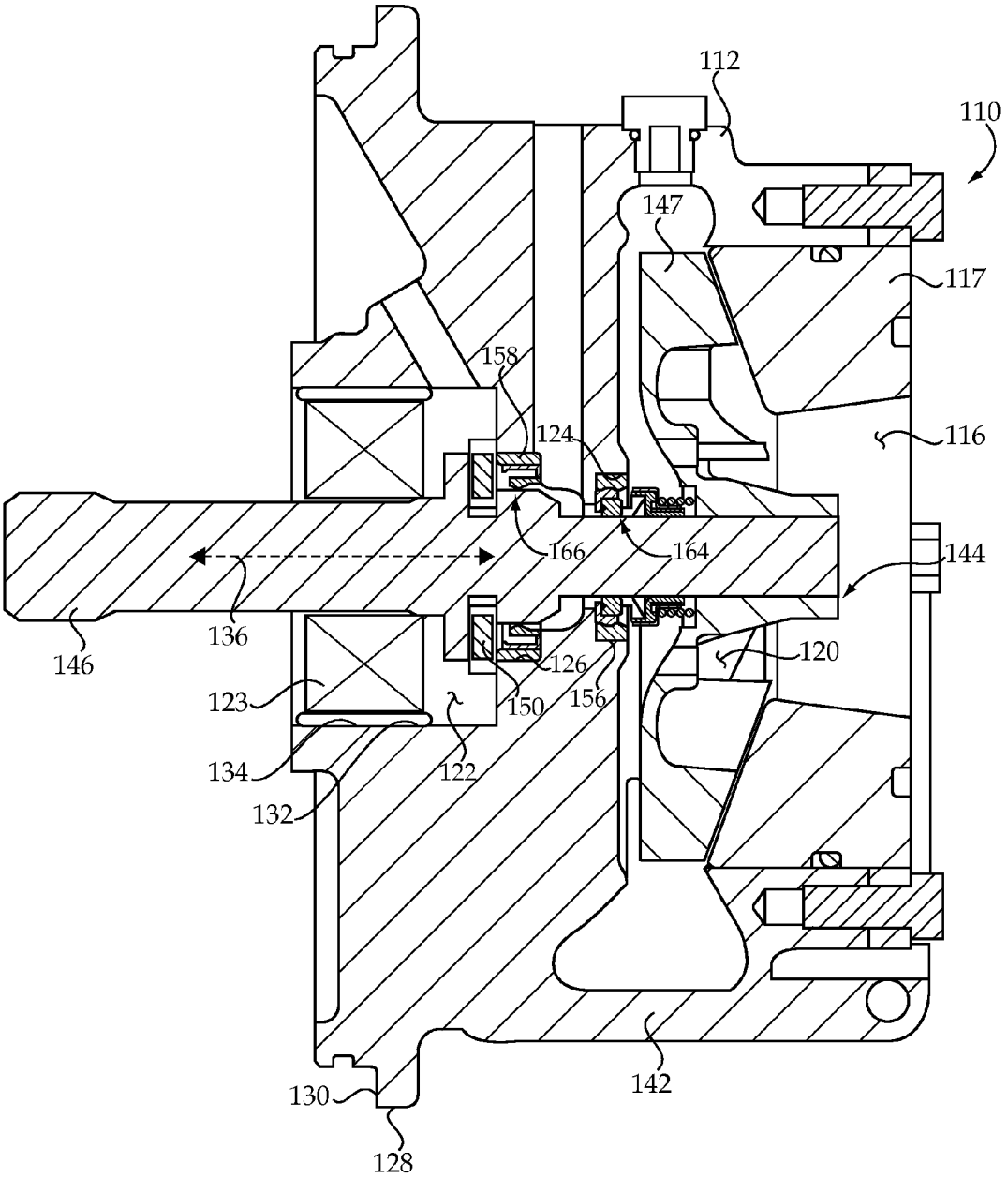
FIG. 4 is a sectioned side view of the pump of FIG. 2.

Referring now to FIG. 2, there is shown a remanufactured pump 110 according to another embodiment. Pump 110 has a number of similarities with the previously described pump, but certain differences. Pump 110 includes a casing 112 having a working fluid inlet 116 and a working fluid outlet 118 formed therein. Casing 112 also includes a planar locating surface 130 located upon a mounting flange 128 having a plurality of bolt holes 135 formed therein for bolting to an engine housing, for example. Referring also to FIG. 4, there is shown a sectioned view through pump 110 illustrating further features thereof. In FIG. 4, a second casing body piece or inlet block 117 is shown positioned within casing 112 and is adjacent to a pumping chamber 120 configured to receive an impeller 147 of a pumping mechanism 144 in a manner generally analogous to pump 10. Previously described pump 10 might analogously be equipped with a second body piece similar to piece 117 to provide for proper functioning and clearance around its impeller. Casing 112 also defines a bearing chamber 122 having a bearing 123 positioned therein and rotatably journaling a pump shaft 146 of pumping mechanism 144. Casing 112 further defines a first bore 124 adjoining pumping chamber 120, and a second bore 126 adjoining bearing chamber 122. Bearing chamber 122 may be formed by a bearing bore 132 having an inner surface 134 comprising a cylindrical locating surface and defining a center axis 136. A volute 142 forms a fluid conduit connecting inlet 116 to outlet 118 in a manner generally analogous to that of previously described pump 10. Pump 110 further includes a thrust bearing 150 configured to react thrust loads on pump shaft 146 during operation, a first insert 156 positioned at least partially within first bore 124 and a second insert 158 positioned at least partially within second bore 126. Each of inserts 156 and 158 may be held fast within their respective bores via an interference fit, and may be formed of stainless steel as in the previously described embodiments. An adhesive may also be used to enhance retention of inserts 156 and 158. A first sealing mechanism 164 is positioned at least partially within first insert 156, and a second sealing mechanism 166 is positioned at least partially within second insert 158. Each of sealing mechanisms 164 and 166 may have structure and function analogous to that described in connection with the sealing mechanisms of pump 10 above. In general, the description herein of features and remanufacturing of either of pumps 10 or 110 should be understood to analogously refer to the other, except where otherwise indicated.

INDUSTRIAL APPLICABILITY

Pumps of the type contemplated herein may be subjected to relatively harsh operating conditions such as fairly extreme and rapid temperature changes, and relatively high absolute temperatures consistent with engine cooling applications. The cast iron material of the casing may become damaged or otherwise unsuited for further optimal service in a variety of ways. Corrosion, pitting, warping, enlargement and other defects in the seal bores may be observed when a pump casing is inspected after removing from service in a machine cooling system. Any of these and other problems can render the pump casing unsuitable for further service without repair, in particular risking eventual seal failure if not addressed. Those skilled in the art will be familiar with the desirability in many instances of maintaining a seal as close to ideally co-axial as possible about a rotating shaft. Deviations from a co-axial arrangement of the seals can result in premature wear, an undue amount of leakage, and eventually total seal failure. In the context of the present disclosure, each of the sealing mechanisms about the pump shaft will be located in a newly manufactured pump based upon their placement within their respective seal bores defined by the casing. Accordingly, where the seal bores are to be repaired upon remanufacturing a pump casing, it is desirable to enable locating the sealing mechanisms at least as precisely as originally specified after the repairs. The present disclosure contemplates a unique remanufacturing strategy to ensure that sealing mechanism 64 and 66, and by analogy sealing mechanisms 164 and 166, are located via their placement within inserts 56 and 60, and by analogy inserts 156 and 158, at least as precisely as they are located in a newly manufactured pump.

Figure 5:
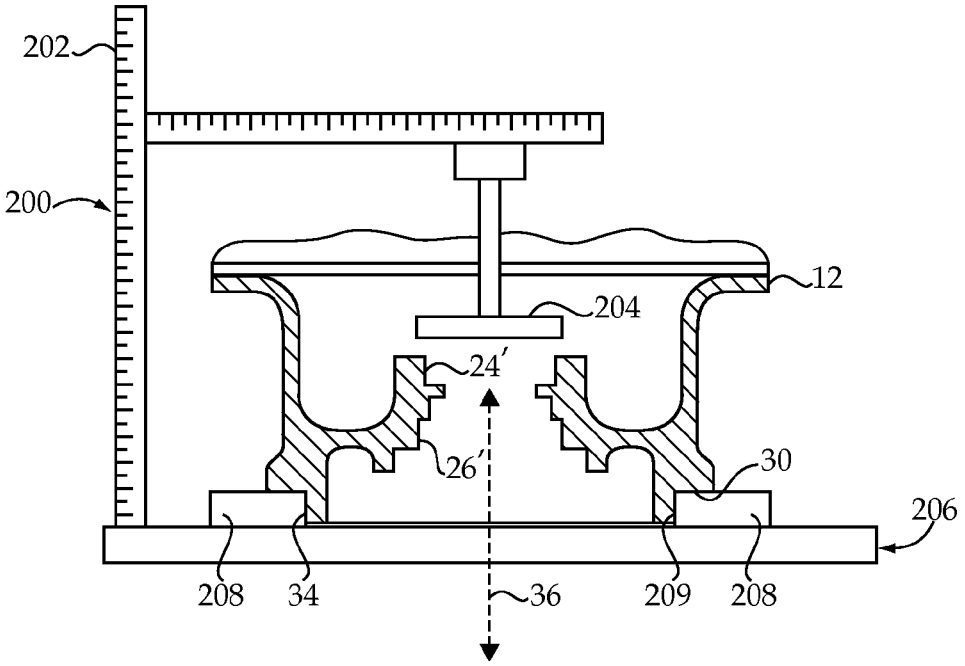
FIG. 5 is a diagrammatic view at one stage of remanufacturing a pump, according to one embodiment.

Referring now to FIG. 5, there is shown casing 12 as it might appear at one stage of a remanufacturing process according to the present disclosure. As noted above, the present description of casing 12 similarly refers to remanufacturing casing 12 except where otherwise indicated. Casing 12 is supported upon a fixture 206 defining a first set of positioning coordinates for repairing a first seal bore defect in casing 12, such as pitting, corrosion, or warping. It will be recalled that casing 12 includes cylindrical locating surface 34, configured to extend circumferentially about pump shaft 46 when positioned therein, and planar locating surface 30 oriented normal to axis 36. Fixture 206 may be equipped with a plate 208 having a circular hole 209 formed therein which receives casing 12 to contact both locating surface 30 and locating surface 34. Coupled with fixture 206 is a machining apparatus 200 having locating elements 202 coupled with a tool 204 such as a rotary cutting or grinding tool. A defective seal bore shown via reference numeral 24' is the seal bore used to locate a sealing mechanism in casing 12 when originally manufactured as a one-piece casting. Tool 204 may be actuated and moved according to the first set of positioning coordinates to machine casing 12 to remove material forming seal bore 24'. Prior to placing casing 12 upon fixture 206, the first set of positioning coordinates may be established by probing fixture 206 with a conventional CNC probe, in particular the inside diameter of plate 208 defining hole 209 and the upper surface of plate 208. Those positioning coordinates may thus be used for locating tool 204 in three dimensions in a conventional manner. After removing material forming the original seal bore, insert 56 may be interference fitted into casing 12 in place of the removed material, and inner surface 58 may be finish machined to a cylindrical shape. Each of these steps of removing material, interference fitting insert 56 in place of the removed material, and finish machining insert 56 may occur while casing 12 is supported upon fixture 206.

Figure 6:
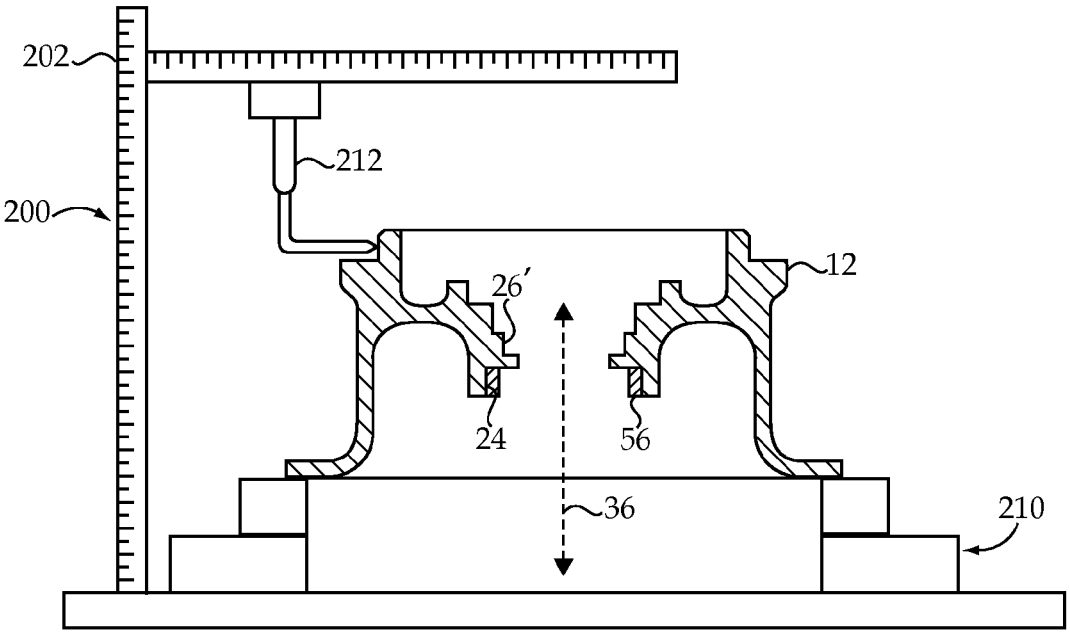
FIG. 6 is a diagrammatic view at another stage of remanufacturing the pump.
Figure 7:
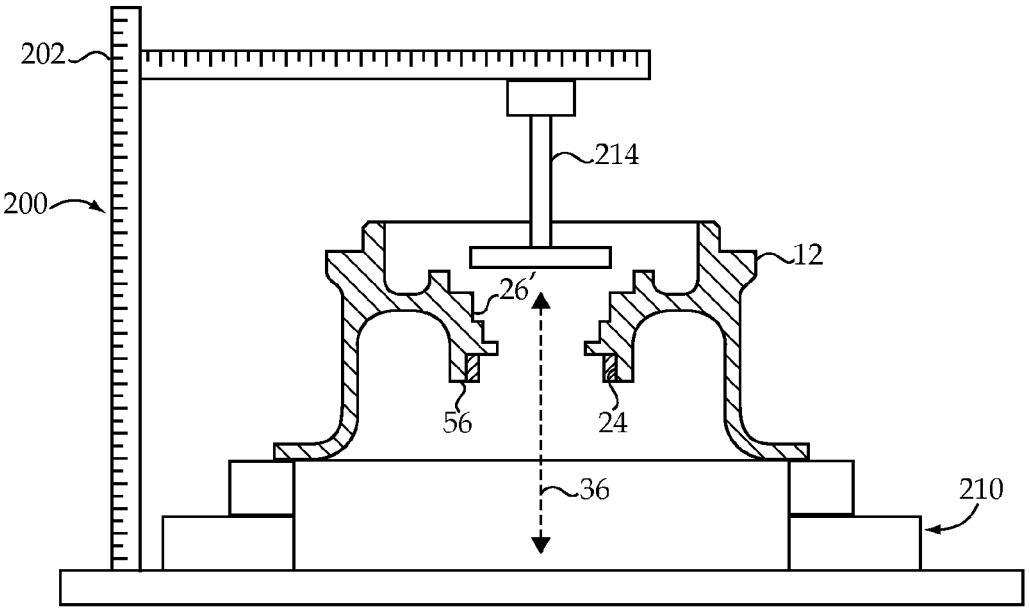
FIG. 7 is a diagrammatic view at yet another stage of remanufacturing the pump.

Referring now to FIG. 6, there is shown casing 12 having been decoupled from fixture 206, coupled with a second fixture 210 and surfaces 30 and 34 probed via a probe 212 to establish a second set of positioning coordinates for repairing a second seal bore defect in casing 12. In this case, the seal bore defect may be in material of casing 12 forming the second original seal bore, shown via reference numeral 26'. With the second set of positioning coordinates established, the second seal bore defect in casing 12 may be repaired via machining casing 12 to remove material forming second seal bore 26', interference fitting second insert 60 into casing 12 in place of the removed material, and finish machining the inner surface of second insert 60 to a cylindrical shape. FIG. 7 illustrates casing 12 supported upon fixture 210 with another tool 214 coupled with machining apparatus 200 in place of probe 212 and located via the second set of positioning coordinates. Those skilled in the art will be familiar with the concept of runout. In the case of casing 12, cylindrical locating surface 34 and planar locating surface 30 serve as datums for performing the repair of the seal bore defects. The inner surfaces of inserts 56 and 60 after finish machining may each have a total runout relative to center axis 36 totaling no more than 0.13 mm. Thus, the inner surfaces may be understood to be coaxial with cylindrical locating surface 30 within a total runout tolerance of 0.13 mm.

Figure 8:
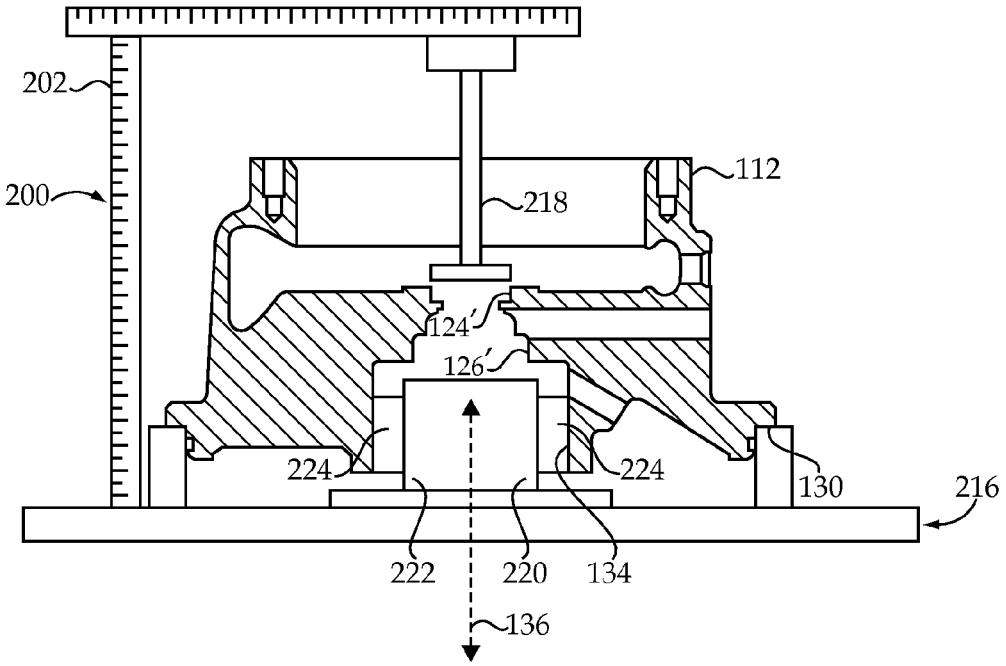
FIG. 8 is a diagrammatic view at one stage of remanufacturing a pump, according to another embodiment.

Referring now to FIG. 8, there is shown casing 112 supported upon a fixture 216 and as it might appear just prior to commencing machining material of casing 112 forming a first seal bore 124' via a machining tool 218. Fixture 216 contacts planar locating surface 130, and further includes a locating mandrel 220 having expandable locating elements 224 and a base 222. Locating elements 224 are shown contacting cylindrical locating surface 134. Repairing seal bore defects in casing 112 may proceed in a manner generally analogous to that used in connection with casing 12 as mentioned above. Instead of locating on an outer diameter cylindrical locating surface such as surface 34 in casing 12, machining of casing 112 includes locating upon inner diameter cylindrical locating surface 134. While most mandrels expand, enlarging to engage on an inner surface of a component, mandrel 220 in contrast may contract as it engages casing 112, albeit only by a few thousandths inches. Positioning coordinates for the stage depicted in FIG. 8 may be established by probing mandrel 220 prior to placing casing 112 therein. In the stage depicted in FIG. 8, casing 112 may be machined to remove material forming the first original seal bore, in preparation for interference fitting insert 156 therein. Insert 156 may then be finish machined, casing 112 flipped over and placed upon another fixture, surfaces 130 and 134 probed to establish positioning coordinates, and additional material forming the second original seal bore 126' removed in preparation for interference fitting insert 158 into casing 112. The inner surface of insert 160 may then be finish machined. Inner surfaces of inserts 156 and 158 may each have a total runout relative to axis 136 of 0.13 mm or less, and in the case of insert 156 the total runout may be 0.05 mm.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A remanufactured pump for a machine cooling system comprising:

a casing removed from service in a machine cooling system and defining a working fluid inlet, a working fluid outlet, a pumping chamber fluidly between the working fluid inlet and outlet, and a bearing chamber, and the casing further defining a first bore adjoining the pumping chamber, and a second bore adjoining the bearing chamber;

a pumping mechanism including a rotatable pump shaft extending through the first and second bores, and an impeller mounted upon the pump shaft and rotatable within the pumping chamber;

a first insert held within the first bore via an interference fit, and having a first cylindrical inner surface;

a second insert held within the second bore via an interference fit, and having a second cylindrical inner surface;

a first sealing mechanism positioned at least partially within the first insert in contact with the first cylindrical inner surface and forming a first seal about the pump shaft to prevent leakage of a working fluid from the pumping chamber; and a second sealing mechanism positioned at least partially within the second insert in contact with the second cylindrical inner surface and forming a second seal about the pump shaft to prevent leakage of a lubricating fluid from the bearing chamber, wherein the first cylindrical inner surface defines a smaller inner diameter dimension, and the first sealing mechanism includes a stationary seat in contact with the first cylindrical inner surface and a rotatable sealing ring positioned upon the pump shaft and forming a face seal with the stationary seat; and the second cylindrical inner surface defines a larger inner diameter dimension, and the second sealing mechanism includes a stationary seal carrier contacting the second cylindrical inner surface, and a stationary sealing ring forming a lip seal with the pump shaft.

2. The pump of claim 1 wherein the casing further defines a low pressure space, and a weep chamber extending between the first and second bores and being in fluid communication with the low pressure space.

3. The pump of claim 1 wherein the casing includes a cast iron body having each of the first and second bores formed therein, and each of the first and second inserts includes a stainless steel ring.

4. The pump of claim 3 wherein the casing further includes a cylindrical locating surface extending circumferentially about the pump shaft, and wherein each of the first and second cylindrical inner surfaces is coaxial with the cylindrical locating surface within a total runout tolerance of 0.13 millimeters.

5. The pump of claim 4 wherein the cylindrical locating surface includes an inner diameter surface of a bearing bore in the casing having a bearing positioned therein and rotatably journaling the pump shaft, and the casing further includes a planar locating surface oriented normal to the cylindrical locating surface and having a plurality of bolt holes formed therein.

6. The pump of claim 4 wherein the cylindrical locating surface includes an outer diameter surface of a mounting protuberance of the casing, and the casing further includes a planar locating surface oriented normal to the cylindrical locating surface and having a plurality of bolt holes formed therein.

7. A remanufactured pump casing removed from service in a machine cooling system comprising:

a body defining a working fluid inlet, a working fluid outlet, and a pumping chamber positioned fluidly between the working fluid inlet and outlet and configured to receive an impeller for transitioning a working fluid from the working fluid inlet to the working fluid outlet;

the body further defining a bearing chamber, a first bore adjoining the pumping chamber, and a second bore adjoining the bearing chamber, and the first and second bores being configured to receive a rotatable pump shaft therethrough having the impeller mounted thereon, wherein the body further includes a cylindrical locating surface defining a center axis extending through the first and second bores, and each of the first and second bores is coaxial with the cylindrical locating surface within a total runout tolerance of 0.13 millimeters;

a first insert held within the first bore via an interference fit, the first insert having a first cylindrical inner surface and being configured to receive a first sealing mechanism for forming a first seal about the pump shaft to prevent leakage of the working fluid from the pumping chamber; and a second insert held within the second bore via an interference fit, the second insert having a second cylindrical inner surface and being configured to receive a second sealing mechanism for forming a second seal about the pump shaft to prevent leakage of a lubricating fluid from the bearing chamber.

8. The pump casing of claim 7 wherein the body further includes a first axial body end having the working fluid inlet formed therein, a second axial body end, and a volute positioned between the first and second axial body ends and forming a fluid conduit connecting the pumping chamber to the working fluid outlet.

9. The pump casing of claim 8 wherein the body further defines a low pressure space, and a weep chamber extending between the first and second bores and being in fluid communication with the low pressure space.

10. The pump casing of claim 9 wherein the body is formed of cast iron, and each of the first and second inserts includes a stainless steel ring.

11. A method of remanufacturing a pump comprising the steps of:

receiving a casing for the pump removed from service in a machine cooling system, the casing having a first seal bore adjoining a pumping chamber configured to receive an impeller for transitioning a working fluid from a working fluid inlet to a working fluid outlet, and a second seal bore adjoining a bearing chamber configured to receive a bearing for a rotatable pump shaft coupled with the impeller;

supporting the casing upon a fixture defining a first set of positioning coordinates for repairing a first seal bore defect in the casing;

repairing the first seal bore defect while supported upon the fixture via machining the casing to remove material forming the first seal bore, interference fitting a first insert into the casing in place of the removed material, and finish machining an inner surface of the first insert to a cylindrical shape;

establishing a second set of positioning coordinates for repairing a second seal bore defect in the casing via decoupling the casing from the fixture and probing the casing; and repairing the second seal bore defect in the casing while decoupled from the fixture via machining the casing to remove material forming the second seal bore, interference fitting a second insert into the casing in place of the removed material, and finish machining an inner surface of the second insert to a cylindrical shape.

12. The method of claim 11 wherein finish machining the inner surfaces of each of the first and second inserts includes finish machining the inner surface to a state coaxial with a cylindrical locating surface on the casing within a total runout tolerance of 0.13 millimeters.

13. The method of claim 12 wherein the step of supporting includes contacting the fixture with the cylindrical locating surface and a planar locating surface on the casing oriented normal to the cylindrical locating surface.

14. The method of claim 13 further comprising a step of establishing the first set of positioning coordinates via probing the fixture prior to the positioning step, and the step of establishing the second set of positioning coordinates further including probing each of the cylindrical and planar locating surfaces.

15. The method of claim 14 wherein the cylindrical locating surface includes an inner diameter surface in a bearing bore of the casing, and the step of supporting further includes a step of positioning the casing such that a locating mandrel of the fixture contacts the cylindrical locating surface.

16. The method of claim 14 wherein the step of positioning further includes contracting the mandrel.

17. The method of claim 14 wherein the cylindrical locating surface includes an outer diameter surface on a mounting protuberance of the casing, and the step of supporting further includes a step of receiving the mounting protuberance within a circular hole formed in a locating plate of the fixture.

* * * * *